US005551174A

United States Patent [19]

Perrissoud

[11] Patent Number: 5,551,174

[45] Date of Patent: Sep. 3, 1996

[54] ALPINE SKI BOOT WITH FOOT TIGHTENING DEVICE

[75] Inventor: Claude Perrissoud, Saint-Jorioz, France

[73] Assignee: Salomon S. A., Metz-Tessy, France

[21] Appl. No.: 358,759

[22] Filed: Dec. 19, 1994

[30] Foreign Application Priority Data

Dec. 24, 1993 [FR] France ..... 93 15944

[51] Int. Cl.[6] ..... A43B 5/04

[52] U.S. Cl. ..... 36/50.5; 36/117.1

[58] Field of Search ..... 36/117, 119, 120, 36/121, 50.5

[56] References Cited

U.S. PATENT DOCUMENTS

| | | | |
|---|---|---|---|
| 3,545,106 | 12/1970 | Martin | 36/50 |
| 3,975,838 | 8/1976 | Martin | 36/50 |
| 4,096,605 | 6/1978 | Annovi | 36/50.5 X |
| 4,142,307 | 3/1979 | Martin | 36/50 |
| 4,245,410 | 1/1981 | Moliter | 36/117 |
| 4,408,403 | 10/1983 | Martin | 36/115 |
| 5,272,823 | 12/1993 | Perrissoud | 36/119 |
| 5,279,052 | 1/1994 | Perotto et al. | 36/50.5 |

FOREIGN PATENT DOCUMENTS

| | | | |
|---|---|---|---|
| 0441776 | 8/1991 | European Pat. Off. | A43B 5/04 |
| 0479123 | 4/1992 | European Pat. Off. | A43B 5/04 |
| 0500479 | 8/1992 | European Pat. Off. | A43B 5/04 |
| 0569305 | 11/1993 | European Pat. Off. | A43B 5/04 |
| 2691333 | 11/1993 | France | A43B 5/04 |
| 82559A/86 | 7/1986 | Italy . | |

*Primary Examiner*—Paul T. Sewell
*Assistant Examiner*—Ted Kavanaugh
*Attorney, Agent, or Firm*—Greenblum & Bernstein P.L.C.

[57] ABSTRACT

The invention is related to a ski boot having a pivoting front cuff including a rigid shell base on which is at least partially journaled an upper that includes a front cuff and a rear spoiler, the front cuff being pivotally mounted in the end zone of the shell base and covering a longitudinal slit provided in its upper front portion. On either side of the longitudinal slit of the front cuff are defined two transverse tongues that are joined together by at least one flexible traction element interposed between an anchoring element of one of the transverse tongues and a manoeuvering member affixed to the other transverse tongue so as to constitute an inner foot tightening device. According to the invention, the front portion of the front cuff includes slots adapted to allow its free sliding with respect to the corresponding spacers of the tongues so as to be applied permanently thereupon, regardless of the relative position of the tongues in accordance with the state of the inner foot tightening device.

14 Claims, 3 Drawing Sheets

ALPINE SKI BOOT WITH FOOT TIGHTENING DEVICE

BACKGROUND OF THE INVENTION

1. Field of the Invention

The present invention is related to a ski boot that includes a rigid shell base on which an upper is at least partially journaled, the upper including a front cuff and a rear spoiler, the front cuff being pivotally mounted in the end zone of the shell base and covering a longitudinal slit obtained in its upper front portion.

More particularly, two transverse tongues are defined on either side of the longitudinal slit of the front cuff of the boot, these tongues being joined to one another by at least one flexible or rigid traction element interposed between an anchoring element of one of the transverse tongues and a manoeuvering member affixed to the other transverse tongue so as to constitute an inner foot tightening device.

2. Discussion of Background and Material Information

A boot of the aforementioned type is described in European Patent Publication No. 479,123, wherein the front cuff is capable of a vertical clearance when the upper is opened. The clearance is allowed by means of a device connecting the shell base which determines the displacement amplitude with respect to a reference abutment.

In this known boot, the inner tightening of the foot is accomplished by means of a device acting upon the inner transverse tongues by initially taking support on the front cuff, and transmitting the tightening force by a traction element, for example a cable, whose path is predetermined and comprises angle return members.

It is easily understood that such a device is not only complex, but causes cable friction in various areas, resulting in inadequate tightening efficiency. In addition, and especially in the case of small feet, the maximum tightening of the transverse tongues about such feet results in the formation of a substantial backlash between the transverse tongues and the cuff, despite its ability for vertical clearance, that is limited, and at any rate, independent of the tightening movement of the tongues. This results in the formation of an unnecessarily large outer volume and overall appearance of the boot.

European Patent Publication No. 441,776 also discloses a boot wherein the transverse tongues that exert a tightening motion on the foot are not superimposed, and are brought closer to one another by an actuating device that directly takes support on each of the tongues and encompasses the cuff.

The disadvantage of such a system is that it causes a displeasing sinking of the cuff at the moment of tightening. In addition, at the moment of release, when the boot is opened for walking, for example, the cuff thus freed by the tightening device that has become inoperative, no longer ensures the necessary impermeability with respect to the shell base, because it has a tendency to rise.

Another boot is also known according to Italian Patent Application No. 82 559 A/86, wherein the shell base is not covered by a cuff, but is closed only by transverse tongues that both tighten as well as cover the foot. This application also describes an inner foot tightening device whose specialty is to exert a supporting action of the bottom of the foot and the plantar arch, via means that are positioned and act on the tongues of the shell. These means are constituted by a member affixed to an anchoring element, a traction cable or a member for maneuvering such cable, and sliding in a slot of the tongues.

In this way, when a traction is exerted on the cable, initially action is exerted on the inner foot tightening device which is beneath such foot, until the sliding member comes into abutment at one end of the slot; from this moment onwards, and secondly, action is exerted on the actual transverse tongues, which constitutes the actual tightening action on the top of the foot. This results in a tightening action on the foot in two opposing directions, resulting in the detrimental effect of not providing a positive seat for the foot on the sole of the boot. In addition, as in the previously cited document, the absence of a cuff weakens the impermeability of the boot.

SUMMARY OF THE INVENTION

It is the object of the present invention to overcome all the disadvantages cited in the prior art.

To this end, the invention is related to a ski boot having a rigid shell base on which an upper is at least partially journaled, the upper including a front cuff and a rear spoiler, the front cuff being pivotally mounted in the end zone of the shell base and covering a longitudinal slit obtained in its upper front portion, on either side of which are defined two lateral portions transverse tongues that are joined to one another by at least one rigid or flexible traction element interposed between an anchoring element of one of the transverse tongues and a manoeuvering member affixed to the other transverse tongue so as to constitute an inner foot tightening device. This boot includes the feature that the anchoring element as well as the manoeuvering member are affixed to each of the transverse tongues by means of spacers on which they are fixedly mounted, so as to mutually define, by their respective planes and the upper planes of each of the corresponding tongues, a space having a height substantially equal to the thickness "e" of the front cuff, being freely housed there by means of transverse sliding slots thereof that are crossed by the spacers, and that are covered by the lower planes of the anchoring element and the manoeuvering member, so as to ensure a permanent application of the front cuff against the tongues in a vertical direction, while at the same time allowing its free sliding on the tongues in a transverse direction, regardless of the relative position of the tongues, whether they are close together in an active tightening position, or conversely, whether they are spaced apart in a freed position.

In this way, it is possible to obtain a boot with a cuff, thus rendering it perfectly impermeable, and whose inner foot tightening is done with maximum efficiency because it acts directly on the transverse tongues, without any intermediate element, regardless of whether the tightening means are in a positive active position or whether they are released.

In addition, the invention provides inner retention of the foot basically in the direction of the sole, thus endowing it with better stability.

Finally, by virtue of the cuff's capacity to follow all tightening or releasing motions provided to the transverse tongues, the boot acquires a real fitting volume with respect to the volume of the foot.

In fact, and to summarize, a primary objective achieved by the invention is to provide an impermeable boot whose front cuff is in permanent contact, in a slidable manner, with the movable transverse tongues, depending upon the tightening to be obtained on the foot by means of an outer device acting directly on the tongues, and not in connection with the cuff which is simply, merely carried along.

BRIEF DESCRIPTION OF THE DRAWINGS

The invention will be more fully described and other characteristics and advantages of the invention will become apparent from the description that follows with reference to the annexed drawings that are provided only as non-limiting examples thereof.

DETAILED DESCRIPTION OF THE PREFERRED EMBODIMENTS

Figure 1:
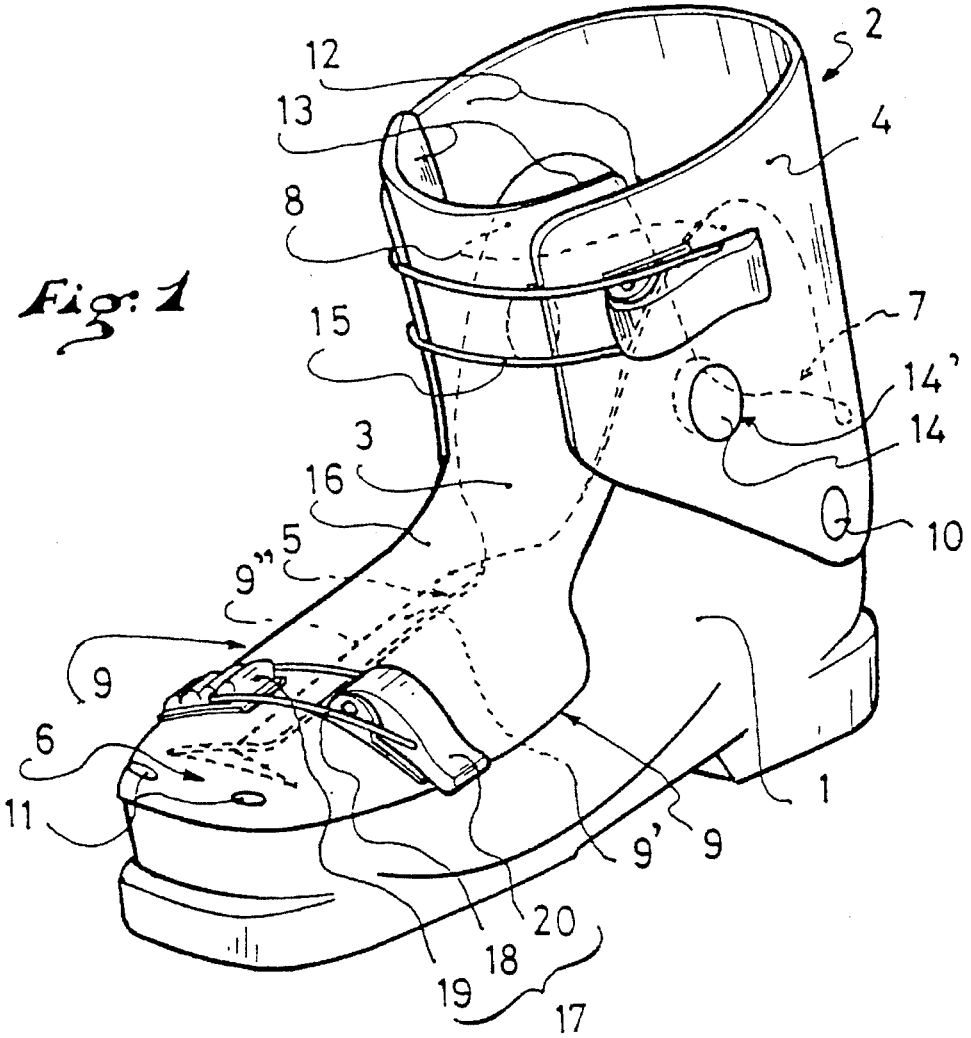
FIG. 1 illustrates, in a perspective view, a ski boot comprising a front cuff linked to an inner foot tightening device according to the invention.
Figure 2:
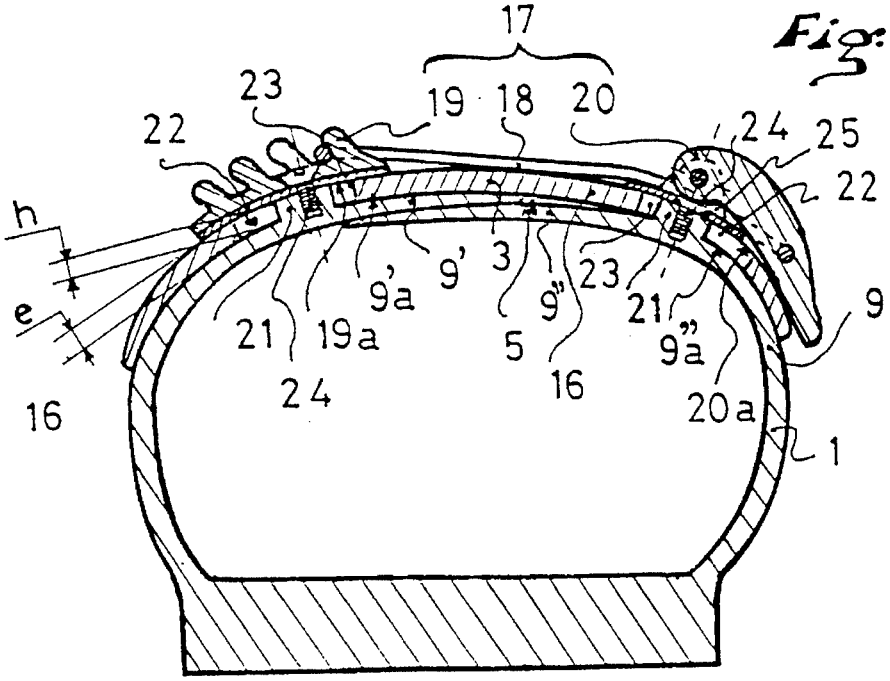
FIGS. 2 and 3 are transverse sectional views along line II—II of FIG. 1, and respectively illustrate the inner tightening device in a closed and open position.
Figure 3:
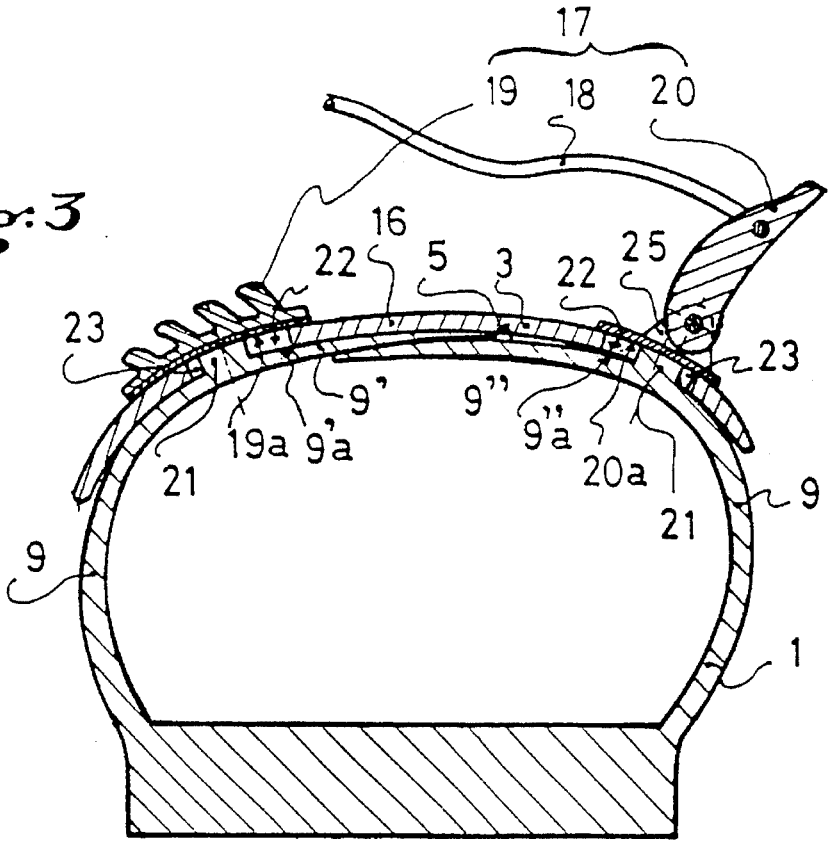

The ski boot that is represented in FIGS.1 through 5 comprises a rigid shell base on which is journaled an upper 2 equipped with a front cuff 3 and a rear spoiler 4. Shell base 1 has an upper longitudinal slit 5 for introduction of the foot that extends from the front end 6 of the boot to the rear end 7. Among others, this slit 5 is demarcated by vertical extensions 8 in the zone of the malleoli and vertical extensions 9 in the front-foot zone, the end of the latter extensions ending in the form of lateral portions or transverse tongues 9', 9", overlapping at least partially so as to envelope the top of the front-foot.

In this embodiment example of the boot, rear spoiler 4 can pivot on shell base 1 in the heel zone about a horizontal transverse axis 10 and front cuff 3, and about attachment points 11 located in the proximity of front end 6 of the boot. In addition, rear spoiler 4 is obtained with two lateral wings 12 that surround, on the one hand, the vertical extensions 8 of shell base 1 on which they become latched by holes 14' on projecting studs 14, and on the other hand, surround at least partially the rear vertical portion 13 of front cuff 3. Rear spoiler 4 thus constitutes, in conjunction with a connection device 15 of wings 12, the closure collar of upper 2 on the lower part of the leg of the skier. with regard to front cuff 3, this is obtained in a single piece, in the shape of a concave channel overlapping the slit 5 of shell base 1 by its rear portion 13 on the zone of the lower part of the leg, and by its front portion 16 on the front-foot zone. The latter covers tongues 9', 9" and at least partially covers vertical extensions 9 that form the walls of shell base 1, approximately perpendicularly to the instep zone.

In accordance with the invention, the boot represented comprises an inner foot tightening device 17 constituted by a flexible traction element 18 interposed between an anchoring element, more particularly a rack 19 affixed to one of the transverse tongues 9" and a manoeuvering member or lever 20 affixed to the other transverse tongue 9' by a mounting member or clip 25.

The role of device 17 is to simultaneously ensure the control of the opening or closing of the front cuff 3 and the inner tightening of the foot in the boot by action on tongues 9' and 9", by means of lever 20 and traction element 18, engaged with a notch of rack 19, selected in accordance with the tightening to be obtained.

In the embodiment represented in FIGS.1 through 5, tongues 9' and 9", defined by longitudinal slit 5 of the front cuff 3, have dimensions that ensure their overlapping on the top of the foot.

In accordance with the invention, the anchoring element or rack 19, as well as manoeuvering member 20 are affixed to each of transverse tongues 9', 9" by means of spacers 21 on which they are fixedly mounted, so as to define, between their respective lower planes 19*a*, 20*a* and the upper planes 9'*a* and 9"*a* of each of the corresponding tongues 9', 9" a space 22 having a height "h" substantially equal to the thickness "e" of portion 16 of front cuff 3 that becomes housed there freely by means of transverse sliding slots 23 thereof that are crossed by the spacers 21, and that are covered by the lower planes 19*a*, 20*a* of anchoring element 19 and of manoeuvering member 20. In this way, a continuous pressure of portion 16 of the front cuff 3 against tongues 9', 9" is ensured, in a vertical direction, while also allowing its free sliding along the tongues in a transverse direction, regardless of the relative position of tongues 9', 9" whether they be close together in an active tightening position, or conversely, spaced apart in a released position.

In addition, intermediate spacers 21 on which anchoring element 19 and manoeuvering member 20 are affixed are cylindrical studs and are adapted to receive at their center, screws 24 for affixing the anchoring element 19 and manoeuvering member 20.

The cylindrical studs 21 constituting the spacers have a diameter "d" smaller than width "l" of transverse slots 23 of cuff 3 that they cross, so as to enable their free transverse sliding in accordance with the relative position of tongues 9', 9".

Figure 5:
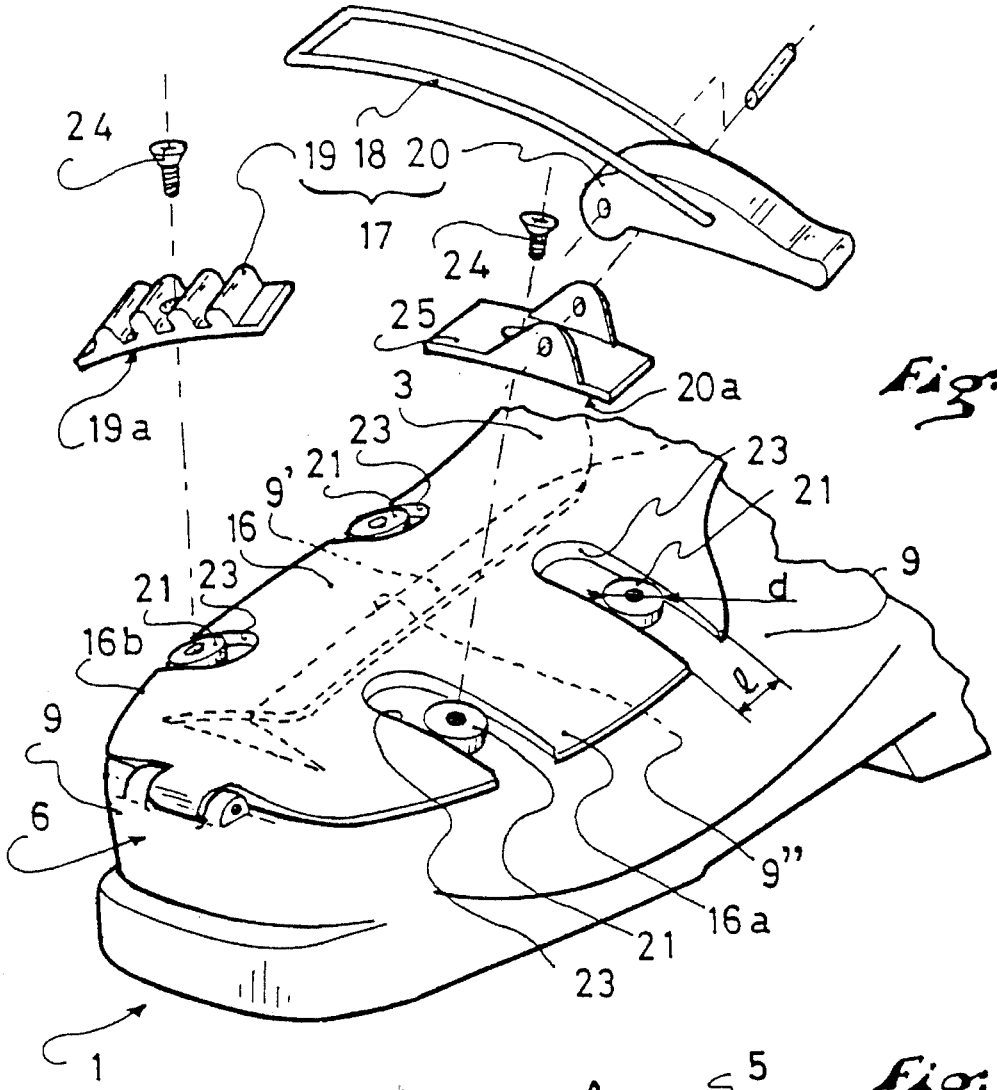
FIG. 5 is a perspective exploded and partial view of a boot according to the preceding drawings.
Figure 4:
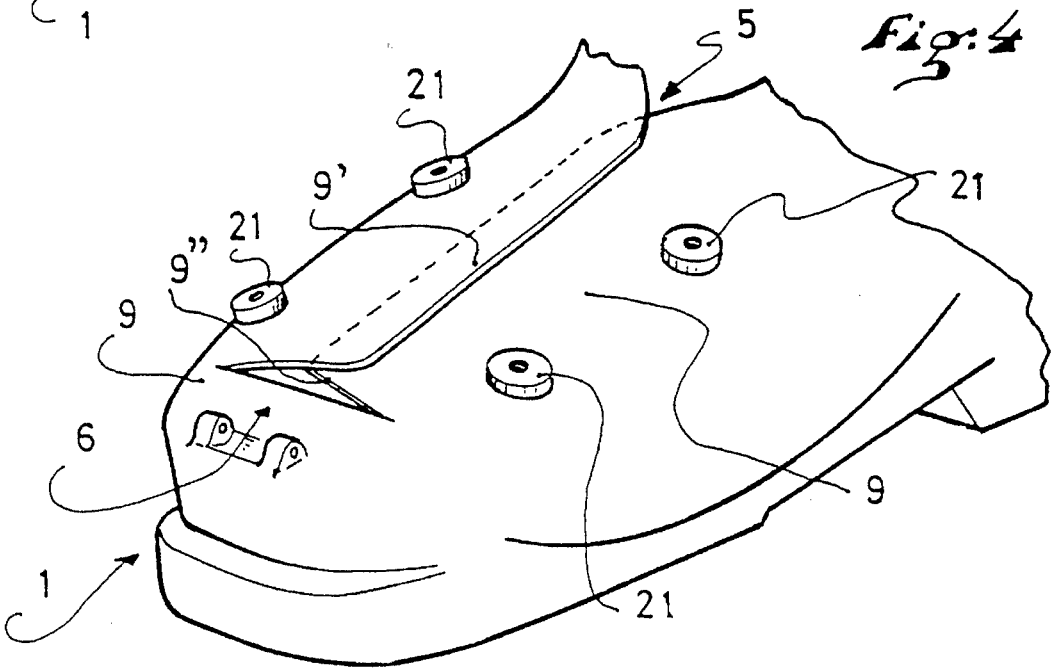
FIG. 4 is a view of a shell base not yet equipped with the front cuff and the inner foot tightening device.

As shown in FIG. 5, sliding slots 23 have an overall oblong shape and merge into the longitudinal edges 16*a* and/or 16*b* of the front portion 16 of front cuff 3, or are closed. These slots 23 can also be alternately open and closed on one side, and closed and open on the other side.

So as to ensure the proper operation of the invention, the lower surface of the base of rack 19 that defines the plane 19*a* has larger dimensions than those of the corresponding sliding slot 23, at least in its width "l", i.e., in the longitudinal direction of front portion 16 of cuff 3.

Similarly, clip 25 on which rocking lever 20 is journaled, has a lower surface that defines the lower plane 20*a*, having larger dimensions than those of the corresponding sliding slot 23, at least in its width "l", i.e., in the longitudinal direction of the cuff 3.

Figure 6:
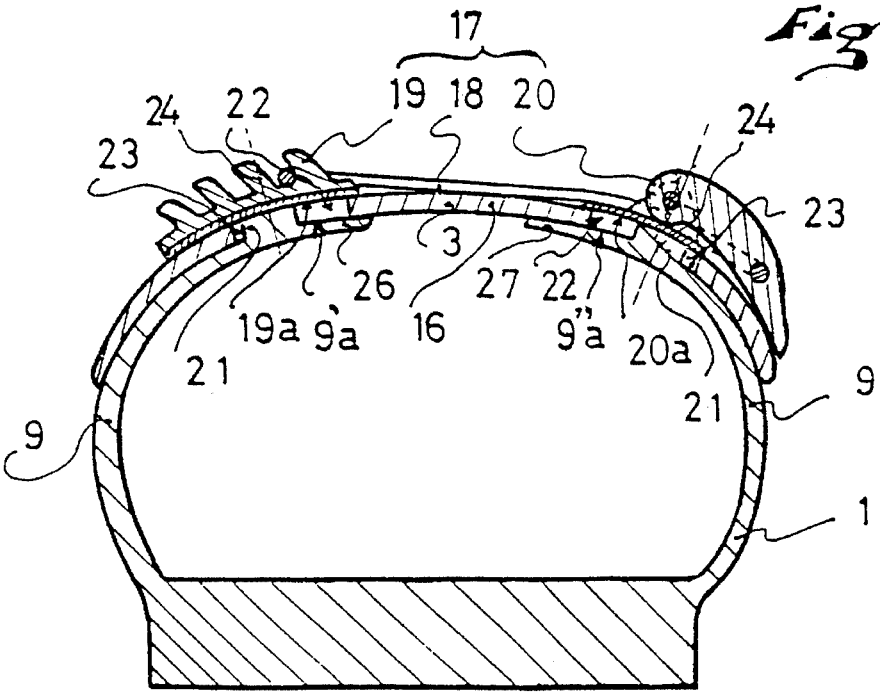
FIG. 6 is a transverse sectional view of a boot according to another embodiment.

According to another embodiment represented in FIG.6, the boot represented mainly differs from the previous one in that the transverse tongues 26, 27 defined by the longitudinal slit 5 of front cuff 3 have such dimensions that they face one another in a non-contiguous manner. All the other component elements of the boot are identical to those described previously, and are thus not redefined.

Regardless of the embodiments described hereinabove, the sliding of rack 19 and the manoeuvering member 20 can be improved with respect to the front portion 16 of cuff 3, by interposing a friction element therebetween, for example made of metal foil, or of a plastic material.

The instant application is based upon French patent application 93.15944 of Dec. 24, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a rigid shell base comprising a pair of lateral portions in at least an upper front portion of said shell base, said pair of lateral portions defining a longitudinally extending slit at least in said upper front portion of said shell base;

an upper and means for journalling at least a part of the upper with respect to the shell base, said upper comprising a front cuff and a rear spoiler, said front cuff covering said longitudinal slit;

at least one foot tightening device comprising an anchoring element affixed to one of said lateral portions of said shell base, a manoeuvering lever attached to a mounting member, said mounting member being affixed to the other of said lateral portions of said shell base, and at least one flexible traction element extending between said anchoring element and said manoeuvering lever;

each said anchoring element and each said mounting member of said manoeuvering lever being mounted upon a respective spacer, each said spacer being affixed to one of said lateral portions of said shell base, wherein a lower surface of each said anchoring element and a lower surface of each said mounting member of said manoeuvering lever and respective upper surfaces of said lateral portions of said shell base define a predeterminate height, said predeterminate height being substantially equal to a predeterminate thickness of said front cuff; and said front cuff including a plurality of transversely extending slots, said spacers extending upwardly within respective ones of said slots, said lower surface of said anchoring element and said lower surface of said mounting member of said manoeuvering lever being positioned over said slots to securely position said front cuff downwardly against said lateral portions of said shell base, whereby said front cuff is mounted for sliding on said lateral portions of said shell base between a tightened position and a released position of said foot tightening device.

2. A ski boot according to claim 1, wherein:

said pair of lateral portions comprise transversely extending tongues.

3. A ski boot according to claim 1, wherein:

said spacers are cylindrical studs having internally threaded centers; and said foot tightening device further comprises screws received within said internally threaded centers of said cylindrical studs for securing respective ones of said anchoring element and mounting member of said manoeuvering lever.

4. A ski boot according to claim 3, wherein:

said transverse slots having predeterminate widths; and said cylindrical studs have a diameter less than said predeterminate widths of said transverse slots for enabling transverse sliding of said lateral portions of said shell base with respect to said front cuff.

5. A ski boot according to claim 4, wherein:

said lateral portions of said shell base comprise respective tongues, said tongues extend transversely in an overlapping arrangement.

6. A ski boot according to claim 4, wherein:

said lateral portions of said shell base face one another and are laterally spaced apart.

7. A ski boot according to claim 1, wherein:

said slots have a generally oblong shape.

8. A ski boot according to claim 7, wherein:

said front cuff having a front portion and opposite lateral edges; and said slots merge into longitudinal edges of a front portions of said front cuff.

9. A ski boot according to claim 8, wherein:

said lateral portions of said shell base comprise respective tongues, said tongues extend transversely in an overlapping arrangement.

10. A ski boot according to claim 8, wherein:

said lateral portions of said shell base face one another and are laterally spaced apart.

11. A ski boot according to claim 1, wherein:

said anchoring element comprises a rack, said lower surface of said anchoring element is a lower surface of said rack, said lower surface of said rack having a width greater than said predeterminate width of a respective one of said slots upon which said rack is positioned.

12. A ski boot according to claim 1, wherein:

said manoeuvering lever is mounted for pivoting on said mounting member, said lower surface of said mounting member of said manoeuvering lever having a width greater than said predeterminate width of a respective one of said slots upon which said mounting member is positioned.

13. A ski boot according to claim 1, wherein:

said lateral portions of said shell base comprise respective tongues, said tongues extend transversely in an overlapping arrangement.

14. A ski boot according to claim 1, wherein:

said lateral portions of said shell base face one another and are laterally spaced apart.

* * * * *